US006851128B1

(12) United States Patent
Parrotte

(10) Patent No.: US 6,851,128 B1
(45) Date of Patent: Feb. 8, 2005

(54) PROTECTIVE TEXTILE JACKET HAVING REMOVABLE WATERPROOF LINING

(75) Inventor: Michael Parrotte, Frederick, MD (US)

(73) Assignee: Intersport, Inc., Fredrick, MD (US)

( * ) Notice: Subject to any disclaimer, the term of this patent is extended or adjusted under 35 U.S.C. 154(b) by 0 days.

(21) Appl. No.: 10/601,284

(22) Filed: Jun. 23, 2003

Related U.S. Application Data

(60) Provisional application No. 60/390,161, filed on Jun. 21, 2002.

(51) Int. Cl.[7] ..... A41D 1/02
(52) U.S. Cl. ..... 2/108
(58) Field of Search ..... 2/97, 456, 457, 2/49.4, 49.5, 69, 81, 93, 102, 108, 59, 904, 70, 915, 272, 164, 125, 126, DIG. 1

(56) References Cited

U.S. PATENT DOCUMENTS 4,608,715 A * 9/1986 Miller et al. ..... 2/1
4,722,099 A * 2/1988 Kratz ..... 2/79
5,105,478 A * 4/1992 Pyc ..... 2/115
5,136,723 A * 8/1992 Aldridge et al. ..... 2/81
5,201,075 A * 4/1993 Svetich ..... 2/108
5,357,635 A * 10/1994 Lemoine ..... 2/84
6,339,843 B1 * 1/2002 Grilliot et al. ..... 2/97
6,427,242 B1 * 8/2002 Bush et al. ..... 2/69
6,698,026 B2 * 3/2004 Schweer ..... 2/94

* cited by examiner

*Primary Examiner*—Tejash Patel
(74) *Attorney, Agent, or Firm*—Miles & Stockbridge P.C.; Edward J. Kondracki

(57) ABSTRACT

A protective jacket is provided, having a mesh outer jacket shell, and a removably fastenable waterproof liner sized and constructed to fit inside the outer jacket shell. The removable liner permits the jacket to be worn as a standard mesh jacket when the liner is removed, or as a waterproof or windproof jacket when the liner is fastened in place.

3 Claims, 2 Drawing Sheets

MESH OUTER SHELL

MESH OUTER SHELL
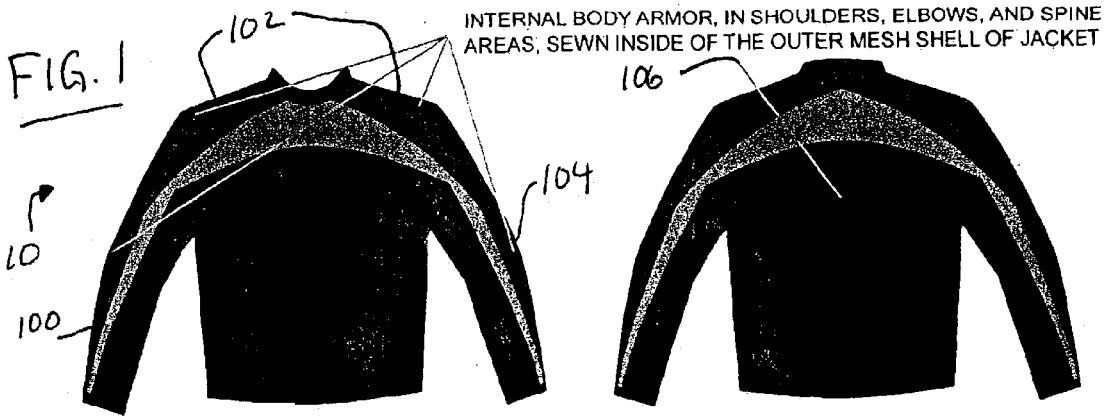
FIG. 2
WATERPROOF REMOVABLE INTERIOR LINER
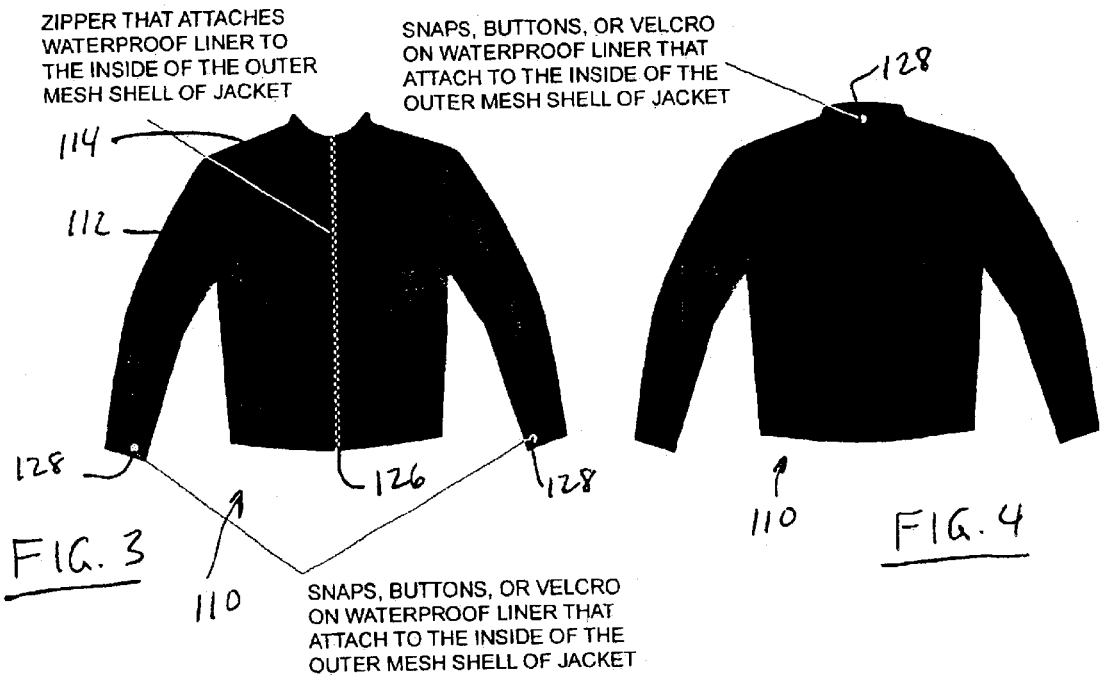
FIG. 3
FIG. 4

PROTECTIVE TEXTILE JACKET HAVING REMOVABLE WATERPROOF LINING

CROSS-REFERENCE TO RELATED APPLICATIONS

This application is based upon the disclosure in U.S. provisional patent application Ser. No. 60/390,161, filed Jun. 21, 2002, and claims the benefit of that filing date.

BACKGROUND OF THE INVENTION

1. Field of the Invention

The present invention is directed to a protective textile jacket, particularly of the type worn by sport recreational motorcyclists and motorcycle commuters, having a removable waterproof lining.

2. Description of Related Art

In the field of motorcycle apparel, and, in particular, in the area of protective jackets, both leather and textiles have been used as the basic jacket material. The protective jackets are fitted with various armor plates, typically at the area of the shoulders, elbows and back, and will frequently have padded areas at the shoulders, arms, and lower back.

Three types of textile jackets are generally available in the market. A first type is a basic nylon jacket, commonly made of Cordura nylon or similar fabric. This basic jacket is not waterproof. A second type of jacket is a waterproof or water resistant jacket, in which the outer shell of the jacket is generally made of the Cordura nylon material and the jacket has a permanent waterproof liner or membrane built into the jacket construction.

A third type of textile jacket that is popular with motorcyclists is what is known as a mesh jacket, in which the shell is made of a fabric having an exposed mesh construction. Mesh jackets, which have substantial areas of open mesh to allow air to flow through the jacket, are considerably cooler, and therefore more comfortable to wear, as temperatures increase. These jackets have the drawback, however, that they are not wind resistant, nor are they water resistant or waterproof. This detracts from their versatility.

SUMMARY OF THE INVENTION

The present invention is directed to providing a mesh protective jacket having a waterproof liner, and, in particular, a removable waterproof liner. By making the waterproof liner removable, the versatility of the jacket is increased substantially. The jacket can be worn as a standard mesh jacket, without the liner, when weather conditions are clear, thereby obtaining the cooling effects of allowing airflow through the mesh to the wearer's body. When weather conditions include precipitation, the waterproof liner can be installed on the jacket, enabling the wearer to stay dry, even though a mesh jacket is being worn. The waterproof liner will also aid in making the jacket more windproof, and thus the liner might also be used in clear but cool, cold, or windy conditions.

The waterproof liner may be made of PVC woven fabric or film, and the liner is provided with fasteners to secure the liner in place inside the mesh jacket.

BRIEF DESCRIPTION OF THE DRAWINGS

These and other features of the present invention and the attendant advantages will be readily apparent to those having ordinary skill in the art, and the invention will be more easily understood from the following detailed description of the preferred embodiment, taken in conjunction with the accompanying drawings wherein the reference characters represent like parts throughout the several views.

FIG. 1 is a front elevation view of a protective jacket in accordance with a preferred embodiment of the present invention.

FIG. 2 is a rear elevation view of a protective jacket in accordance with a preferred embodiment of the present invention.

FIG. 3 is a front elevation view of a removable waterproof liner in accordance with a preferred embodiment of the present invention.

FIG. 4 is a rear elevation view of a removable waterproof liner in accordance with a preferred embodiment of the present invention.

DETAILED DESCRIPTION OF THE PREFERRED EMBODIMENT

Figure 5:
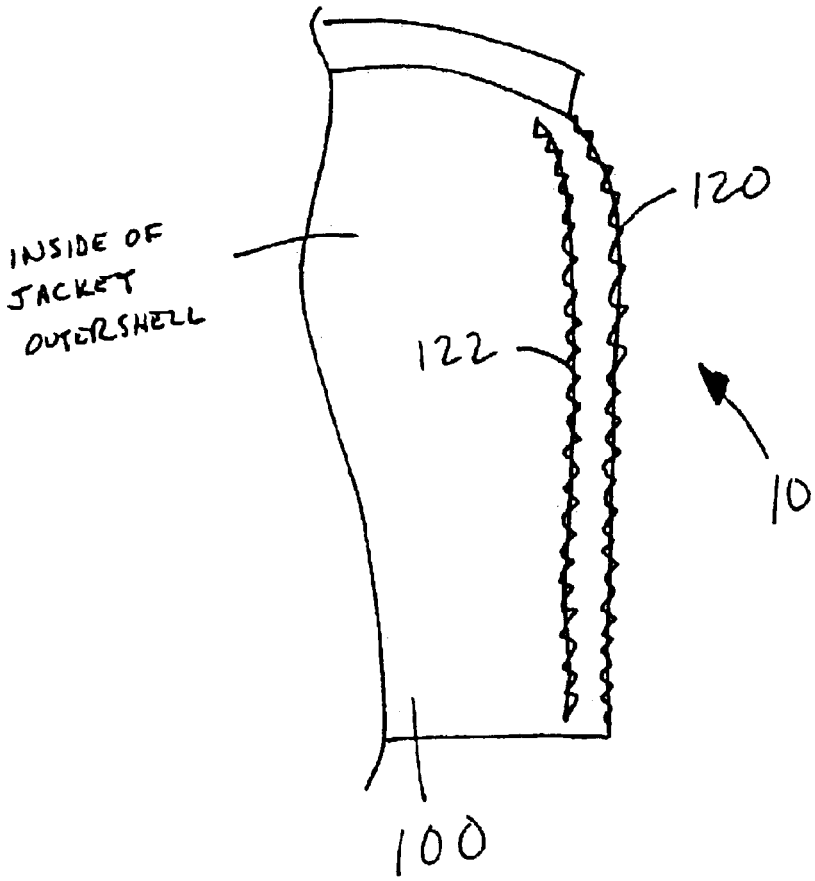
FIG. 5 is an elevation view of an inside portion of the protective jacket according to a preferred embodiment of the present invention.

The protective jacket 10 of the present invention, as seen in FIGS. 1 and 2, has a mesh outer shell 100 forming the desired jacket shape. A plurality of sections of body armor (not shown) are secured inside of the mesh outer shell 100 in known fashion. The sections of body armor are in various sizes and shapes, and are preferably disposed in the shoulders 102 of the jacket, at the elbows 104, and along the back or spine area 106 of the jacket. Conventional securing means can be employed for retaining the armor sections in place, including the provision of pockets sewn onto the interior of the mesh outer shell, or the provision of an inner mesh shell with pockets formed therein. The armor sections may preferably be made of substantially rigid, high-density foam. In addition to the provision of the internal armor, the protective jacket preferably has one or more areas on an exterior of the outer mesh shell which are padded.

The removable waterproof liner 110 is preferably sized to conform to the inner contours of the mesh outer shell 100. The liner may be made of any commonly used waterproof fabric, although a PVC fabric may be preferred in certain instances. Because of the relatively severe wind conditions that are experienced when riding a motorcycle, the waterproof liners may preferably be taped with a waterproof tape at any seams in the liner, for example, at the areas where sleeves 112 are joined to the main liner body 114.

The removable liner 110 is preferably secured into place in the mesh outer shell through a combination of a zipper and other fasteners. As seen in FIG. 5, the outer shell 100 of jacket 10 is provided with a zipper section 122 (one on each side) extending substantially parallel to the main zipper 120, just inside of the main zipper portion. The liner is provided with zipper sections 126 at the lead edges of the liner. These zipper sections 126 are to be compatible with the zipper sections 122 disposed inside the jacket, so that the liner 110 can be zipped into the jacket 100 at this leading edge.

The jacket 100 and liner 110 are also provided with additional cooperating fasteners 128 at other points at the peripheral edges of the liner. It is preferred that the liner be releasably fastened at the back of the neck and at the outer extents of the sleeves of the jacket, as can be seen by the position of the fasteners in FIGS. 3 and 4. The fasteners 128 may take the form of buttons, and the cooperating fastener may be button loops, in this instance. Sections of hook-and-loop fastening materials may also be employed.

Alternatively, snaps may be used in which two cooperating snap elements are disposed with one each on the waterproof liners and on the inside of the outer mesh-shell. The snaps may alternatively both be secured to a flap of fabric on the liner or on the outer shell, that can be looped through a securing loop on the other of the liner or outer shell. The type of fasteners that can be used are great in number. In addition to those mentioned above, clips, additional areas of zippering, and the like, may be used.

The protective jacket 10 may thus be readily transformed from a true mesh jacket having all of the advantages of allowing airflow therethrough, to a waterproof jacket, and back again.

The foregoing description and the drawing figures represent only a preferred embodiment of the invention, and these are provided for illustrative purposes only. Various modifications and changes which will become readily apparent to those of ordinary skill in the art, may be made without departing from the spirit and the scope of the invention.

What is claimed is:

1. A protective jacket, comprising:

an outer jacket shell, constructed substantially completely of an open mesh material;

a liner made of a substantially waterproof material, said liner conforming substantially in shape to a shape of said outer jacket shell, and said liner being removably fastenable within said outer jacket shell.

2. A protective jacket as set forth in claim 1, wherein the liner is removably fastenable to said outer jacket shell by a zipper-type fastener.

3. A protective jacket as set forth in claim 1, wherein the liner is constructed from a PVC material.

* * * * *